United States Patent [19]

Widdershoven

[11] 4,091,768

[45] May 30, 1978

[54] GAS-FIRED BOILER

[75] Inventor: Louis Hubertus Widdershoven, Kerkrade-West, Netherlands

[73] Assignee: Raypak Produkten B.V., Kerkrade, Netherlands

[21] Appl. No.: 752,550

[22] Filed: Dec. 20, 1976

[30] Foreign Application Priority Data

Dec. 22, 1975 Netherlands ..... 7514926

[51] Int. Cl.[2] ..... F22B 37/10; F28F 9/06

[52] U.S. Cl. ..... 122/367 C; 122/360; 165/175

[58] Field of Search ..... 122/264, 265, 360, 367 R, 122/367 C; 165/175, 176

[56] References Cited

U.S. PATENT DOCUMENTS

| | | | |
|---|---|---|---|
| 1,625,082 | 4/1927 | Helbig | 110/72 |
| 3,242,910 | 3/1966 | Hale | 122/265 |
| 3,388,692 | 6/1968 | Hale | 122/367 |
| 3,478,706 | 11/1969 | Carson | 110/72 |
| 3,623,458 | 11/1971 | Block | 122/264 |
| 3,792,729 | 2/1974 | Perry | 122/360 |
| 3,800,748 | 4/1974 | Schindler et al. | 122/367 |

*Primary Examiner*—Kenneth W. Sprague
*Attorney, Agent, or Firm*—Browdy and Neimark

[57] ABSTRACT

A gas-fired boiler having a bed of copper finned tubes arranged between the combustion space and the flue. The ends of the tubes extend through a tube plate into a water header. The connection is sealed with a compressed gasket. For protection of the gasket, the openings in each tube plate and header for allowing the passage of tube end are arranged asymmetrically in the direction of the burner bed.

6 Claims, 3 Drawing Figures

GAS-FIRED BOILER

Figure 1:
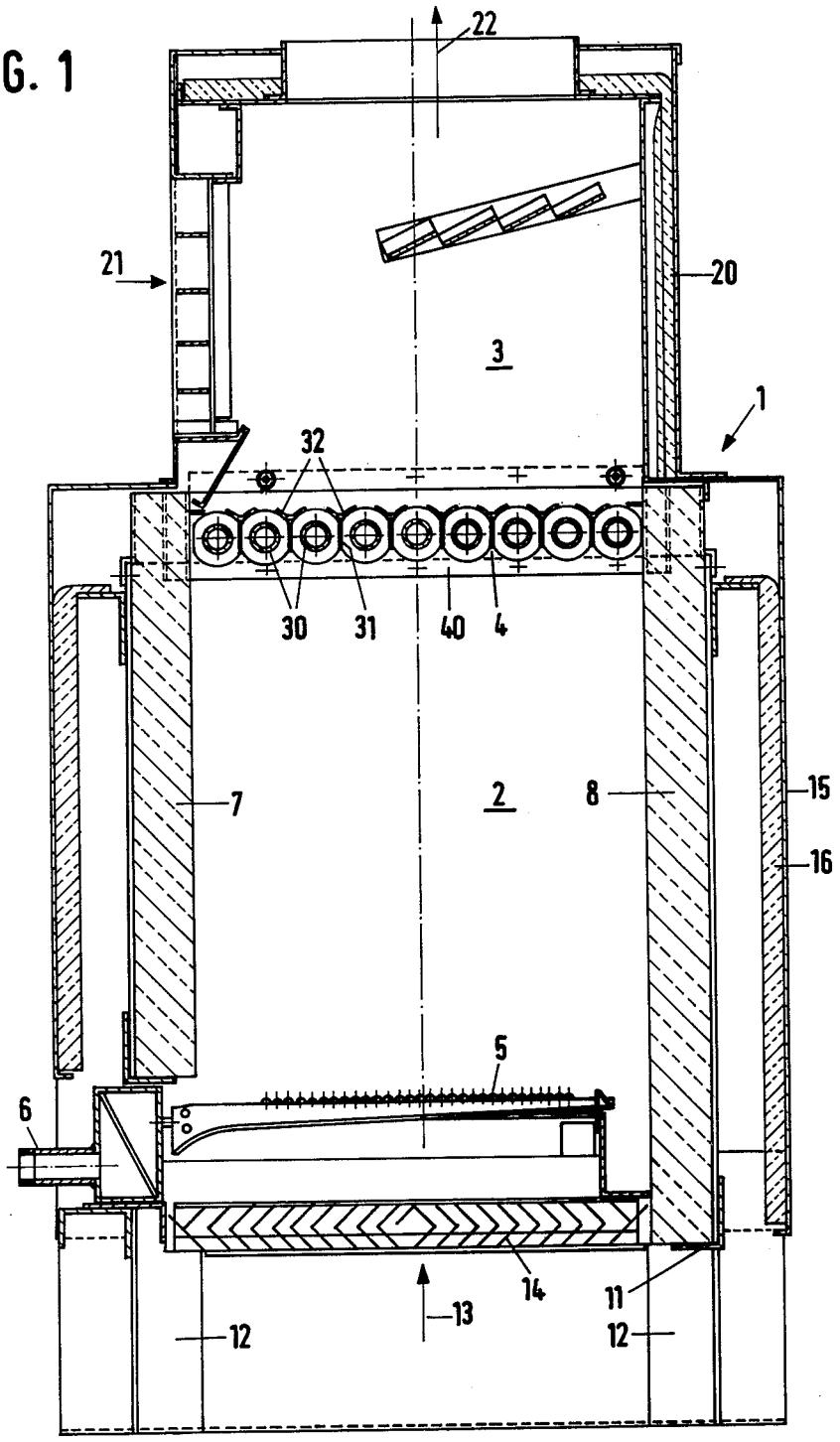

This invention relates to a gas-fired boiler of the kind comprising a burner bed, a combustion space above said burner bed and having an insulating lining, a plurality of copper finned tubes extending in substantially parallel relationship and bounding said combustion space at the top thereof, between which fins combustion gases can flow in heat exchange relationship to a flue, the copper tubes being on opposite ends connected to a header having means for connection to a heated-fluid circuit.

Gas-fired boilers of this kind are used for heating houses, larger buildings, swimming pools, sanitary facilities, etc. Owing to the use of copper finned tubes it is generally possible to effect the required effective decrease in temperature of the combustion gases using a single horizontal row of tubes, whereby proper heat transfer to the fluid to be heated is achieved. Such a boiler can be operated with a very small volume of fluid, such as water, as heating medium, so that for temperatures of the fluid of up to 143° C the boiler need not satisfy the (strict) requirements of a steam boiler. In a conventional construction, the two ends of the finned tubes are rolled into vertical plane tube plates, while water headers are mounted on the outside of these tube plates, which are clamped against the plate, with the ends of the finned tubes each extending through corresponding openings in the headers. To ensure effective sealing, a rubber gasket, often in the form of an O-ring, is arranged on the outside of each finned tube between the tube plate and the facing surface of the header. It has turned out that, with larger sizes of headers, which are accompanied with tube plates of correspondingly larger height, sealing problems occur. From considerations' of cost price and ease of assembly, the simplest possible joint and connection must be aimed at.

It is an object of the present invention to provide an improved gas-fired boiler of the kind described, which involves fewer problems in sealing the finned tubes.

For this purpose it is proposed, according to the present invention, to provide the openings for the finned tubes asymmetrically in the tube plates, namely, more towards the lower edge thereof.

The vertical dimensions of the tube plates are in the main dictated by the dimensions of the headers in connection with the mounting of the studs with which the headers are to be secured to the tube plates. It has now surprisingly been found that sealing problems can be substantially avoided by making the joints of the finned tubes to the tube plates and to the headers asymmetrically, namely, as far towards the burner bed as possible. As the heated surface area of the tube plate below the bank of finned tubes is small, overheating of the tube plate is avoided, which makes for lower temperatures in the vicinity of the seals.

According to a further elaboration of the present invention, the insulating walls of the furnace are preferably extended downwardly beyond the burner bed. This prevents loss of radiant heat through the jacket as effectively as possible, while a better solution is obtained from considerations of construction and cost price as well.

According to a still further elaboration of the present invention, it is proposed to provide under the burner bed an air supply grid having slats of chevron shape in section. Conventionally, combustion air is supplied horizontally in the direction of the burner bed. For this purpose, additional air supply holes must be provided at appropriate places, which may involve further loss of heat. Owing to the use of an air supply grid with chevron-shaped slats under the burner bed, downward radiation is reflected back by the slats, while there is an adequate area for allowing the passage of air to ensure proper combustion. Also, owing to the air flowing from the bottom, effective cooling will be ensured of both the grid and the subjacent part of the building in which the boiler is disposed.

Figure 2:
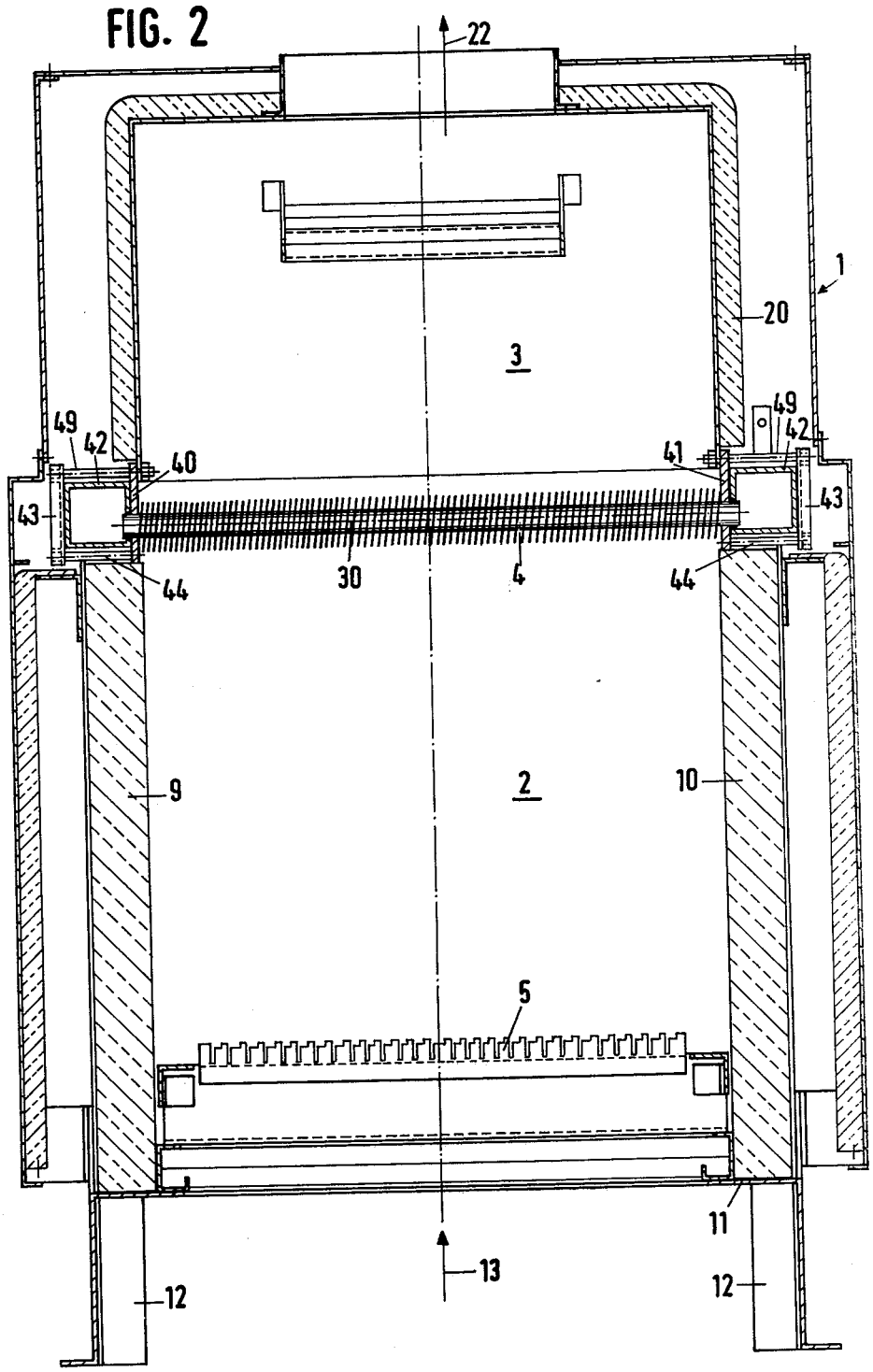
Figure 3:
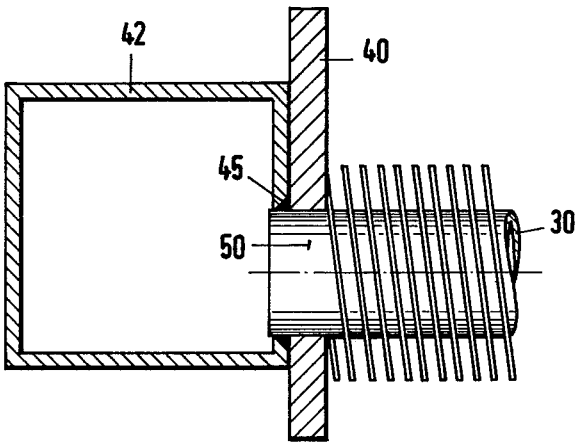

Further features of the present invention will become apparent from the following description, read with reference to the accompanying drawings, showing one embodiment of the invention by way of example. In said drawings, FIG. 1 shows a boiler according to the present invention in vertical sectional view;

FIG. 2 is a vertical sectional view similar to FIG. 1, but turned through 90°; and FIG. 3 shows a detail of a finned tube connection according to the present invention.

Referring to the drawings, there is shown a boiler, generally indicated at 1, and comprising a furnace or combustion space 2 and a flue section 3, located above the furnace. A bank of finned tubes 4 extends between the furnace and the flue. Located at the bottom of the furnace is a burner bed 5 with a gas supply pipe 6. The combustion space is bounded on all sides by insulating walls 7, 8, 9 and 10. The front wall extends down to burner bed 5. In the embodiment shown, the three other walls 8, 9 and 10 extend downwardly considerably beyond burner bed 5, where they rest on a frame 11. Frame 11 is supported with legs 12 on a base or floor of a building, not shown. Disposed under the burner bed is an air supply grid 13, built up from slats 14 which are chevron-shaped in cross-section. The boiler has a jacket comprising steel sheeting 15 with an insulating layer 16. Flue 3 is provided with cladding and insulation, generally indicated at 20. There is further provided a mixing-air supply-opening 21 and a connection for a chimney, indicated by arrow 22.

The bed of finned tubes comprises a plurality of horizontal, parallel, finned copper tubes 30. These tubes are placed as closely together as possible, for which purpose edge portions of the fins have been bent over at 31 over some distance. To promote the flow of hot gases across the tubes and between the fins, baffles 32 are provided above and between each pair of adjacent tubes.

The finned tubes extend on opposite ends through a tube plate 40, 41, respectively, into a water header 42. Each header is secured to the respective tube plates 40 or 41 by means of a plurality of bridge pieces 43 and studs 44. At least the lowermost stud is mounted in the tube plate, a nut being screwed on the stud against the bridge piece. Provided in a suitable recess or bevel in the header is an O-ring or gasket 45. There may be one header at each end of the finned tubes, one being a supply header and the other a discharge header. The water will then flow through all the tubes in parallel. It is also possible, however, to have the water flow in opposite direction through a minor or major proportion of the tubes by appropriately dividing and connecting the headers.

As shown in FIG. 3, the end 50 of a finned tube is rolled into a tube plate 40 and extends into header 42. As header 42 is clamped down on to tube plate 40, gasket 45 is brought under compression into sealing contact with the external surface of tube plate 40, header 42, and the external wall of the end 50 of tube 30. As clearly apparent from FIG. 3, the openings in tube plate 40 and in header 42 for allowing the passage of tube 30 are disposed asymmetrically as far down as possible. It has been found that this prevents premature damage to the seal. It is noted that the tube plate is preferably made of steel, and the O-ring of a silicone rubber or other suitable material.

By having the insulating wall lining 8, 9 and 10 of the combustion space extend downwardly beyond burner bed 5, thermal losses through radiation of heat are prevented to a substantial extent, and simplicity in structural design is achieved.

The supply of combustion air from the bottom through a supply grid with chevron-shaped slats 14 provides for proper combustion, low rates of air supply, and prevents excessive downward radiation of heat, while the air supplied ensures effective cooling.

I claim:

1. In a gas-fired boiler which includes a combustion space having vertical insulating walls, a burner bed at the bottom of said combustion space for combusting the gas, a flue above said combustion space for connection to a chimney, and a bank of copper finned tubes arranged between said flue and said combustion space, said tubes being disposed substantially horizontally in heat-exchange relationship, and extending on opposite ends through respective tube plates into respective water headers, with a gasket arranged under compression between each said header and an outer surface of the adjacent one of said tube plates around each tube end, each said header being symmetrical about a plane of symmetry, the improvement wherein openings in each said plate and in each said header for allowing passage of each said tube end are arranged asymmetrically, in the direction of said burner bed, with respect to said plane of symmetry.

2. A gas-fired boiler according to claim 1, wherein each said header is substantially rectangular in cross-section and has a flat side in surface-to-surface contact with a respective one of said plates.

3. A gas-fired boiler according to claim 1, wherein each said header is respectively in surface-to-surface contact with a respective one of said tube plates under tension by clamping brackets and studs, at least those of said studs located closest to said burner bed being fixedly connected to respective ones of said tube plates.

4. A gas-fired boiler according to claim 1, wherein said combustion space is defined in part by two sidewalls, a rear wall, and an aperture for mounting said burner bed, and further comprising insulating lining on said sidewalls and on said rear wall opposite to said aperture for mounting said burner bed, said lining extending downwardly some distance beyond the top of said burner bed.

5. A gas-fired boiler according to claim 1, and including means for supplying combustion air arranged under said burner bed.

6. A gas-fired boiler according to claim 5, wherein said means for supplying combustion air comprise a grid including slats substantially chevron-shaped in cross-section, and further comprising a boiler jacket and spacer means under said boiler jacket.

* * * * *